United States Patent [19]

Mauroner

[11] 4,219,971

[45] Sep. 2, 1980

[54] POCKET WINDOW

[76] Inventor: Curtis Mauroner, 4709 Lake Villa Dr., Metairie, La. 70002

[21] Appl. No.: 892,504

[22] Filed: Apr. 3, 1978

[51] Int. Cl.[2] ..... E05D 13/02

[52] U.S. Cl. ..... 49/425; 49/372; 49/452; 49/456; 49/457; 49/504; 52/207

[58] Field of Search ..... 49/404, 424, 425, 428, 49/434, 435, 456, 457, 459, 504, 505, 372; 52/207; 49/452, 372

[56] References Cited

U.S. PATENT DOCUMENTS

| | | | |
|---|---|---|---|
| 1,724,186 | 8/1929 | Fox | 49/505 X |
| 1,959,643 | 5/1934 | Plym | 49/457 X |
| 2,541,926 | 2/1951 | Krantz | 49/472 |
| 2,564,265 | 8/1951 | Knott | 49/457 |
| 2,775,798 | 1/1957 | Bent | 49/459 |
| 3,106,754 | 10/1963 | Grossman | 49/425 X |
| 3,295,259 | 1/1967 | Dallaire | 52/207 X |
| 3,436,885 | 4/1969 | Rothermel | 52/207 |
| 3,451,168 | 6/1969 | Pengelly | 49/457 |
| 3,462,884 | 8/1969 | Bissoniere | 49/404 |
| 3,583,101 | 6/1971 | Prudenz | 49/425 X |
| 3,584,417 | 6/1971 | Gatton | 49/404 |
| 3,731,430 | 5/1973 | Dallaire et al. | 49/504 X |
| 4,042,004 | 8/1977 | Kwan | 49/456 X |

FOREIGN PATENT DOCUMENTS 1229255 3/1967 Fed. Rep. of Germany .

*Primary Examiner*—Philip C. Kannan
*Attorney, Agent, or Firm*—Roger L. Martin

[57] ABSTRACT

A multi-sash pocket window is designed to accomodate sash of differing widths and in varying combinations. The window frame structure is adapted to receive inserts for retaining the sash in place and which are selected to accomodate the sash width and combinations being used. At the sill, the inserts have rails for supporting the sash rollers and upright sections that straddle the lower ends of the sash. Ribs are provided for retaining the inserts in place and various example are shown.

13 Claims, 29 Drawing Figures

POCKET WINDOW

BACKGROUND OF THE INVENTION

The invention generally relates to sliding window construction and more particularly to a multiple sash window assembly in which the sash are mounted in parallel, closely spaced planes within a supporting frame for relative horizontal sliding or rolling movement. The invention has particular reference to pocket type window assemblies and more particularly to framing assemblies which include means for permitting changes to be made in the number and/or type of individual sash mounted therein without removing and/or replacing the entire supporting frame.

Pocket type window, or windows of the type that include multiple sash which may be selectively moved to an operative position across the window opening which may be disposed within a pocket formed within the walls of a building in an inoperative position are known.

Such pocket windows, although suitable for the specific purposes they are designed for are unsatisfactory when it comes to changing the number of sash and/or the types of sash used therein. Such windows generally utilize horizontal and vertical framing members having fixed channels within which their sash slide or roll. Such framing members are usually fixed within the window and pocket openings and to the edges of said openings. Therefore, when, for example, sash of different width are desired to be used and/or when additional or different sash are desired to be used and cannot be accommodated therein the supporting frame must be detached from the opening it is affixed to and then completely replaced by framing members which can accommodate the sash changes. In the situation where thicker sash are to be used, such as storm sash or thermalized sash which include multiple layers of glass pane, generally all the horizontal and vertical framing members in the window and pocket opening must be replaced by framing members having wider channels within which said wider sash can be accommodated for proper movement therein. The same is true when sash of different width are desired to be used in a window having framing members which have channels which are all of the same width. In these types of windows there is relatively no flexibility in the type or number of sash that can be used therein.

A method for securing sash to a non-pocket type window has been advocated which utilizes a window frame having two ways, disposed in stepped relationship, and which are provided with a dovetailed groove within which a sash guideway is slidably retained and within which the sash are disposed. Similarly however, this window is unsatisfactory when the number or type of sash are desired to be changed. In order to utilize sash of narrower width a sash guideway having a corresponding channel width must be utilized. This requires that the framing members be detached and removed from the window it is affixed to and narrower sash guideways be slidably installed. In the situation where a wider sash is desired to be utilized both the framing members and sash guideways must be completely replaced. Furthermore this window is not adapted to be used in either a pocket window nor in sliding window construction.

SUMMARY OF THE INVENTION

In general the preferred embodiment of the invention includes a supporting frame set in the pocket and window receiving openings of a building, the supporting frame comprising, a centrally located double window frame unit and two pocket frame units extending from the sides of the window frame unit into pockets formed within the walls of the building. Each pocket frame unit includes an upper, horizontal, insert retaining member, a lower horizontal insert retaining member and a vertical jamb member set in the back of the pocket opening. The window frame unit includes an upper, horizontal, insert retaining member, a lower, one piece, horizontal sill member affixed to the lower edge of the window receiving opening, and two lower, horizontal window sill insert retaining member, mounted on said one piece sill member and a vertical, center post retaining means longitudinally extending from the window header to the one piece horizontal sill member. It also includes two vertical casing assemblies, each comprising an inside and outside casing member which longitudinally extends between the pocket ends of the window header and the horizontal window sill member, at their inside and outside portions, respectively. All of the horizontal and vertical retaining members are adapted to retain inserts which at the sill are equipped with rails for guiding the sash. These sash are mounted therein for sliding and/or rolling horizontal movement, in parallel, closely spaced vertical planes. Furthermore each of the retaining members comprises a generally flat section having a plurality of laterally extending, parallel, spaced apart ribs that define a plurality of recesses in which the inserts are mounted as snap in components. Another embodiment utilizes rail inserts which are longitudinally inserted into dovetail shaped recesses of the retaining means. The inserts for the lower horizontal retaining members of the pocket and window sills generally include a lower base section and a vertical, or upright section which is integral with the base section. The lower base section includes at least one rail for supporting the sash. The sash can either roll or slide on the rail depending on the type of sash assembly utilized. Each upright section of the sill inserts cooperates with another upright section to straddle the lower end of the sash. The insert for the pocket and window headers and the vertical center post retaining means are of substantially the same design as the sill inserts except that they lack the rail section that is usually found in the sill inserts.

A general object of the invention is to provide an improved sliding window construction.

A further object of the invention is to provide an improved pocket type window which is adaptable to be easily modified so as to permit changes in the number or type of sash used therein.

Another object of the preferred embodiment of the invention is to provide a sliding window which is adaptable to permit changes in the number or type of sash used therein without the necessity of detaching any section of the supporting frame from the opening it is affixed to except for the two inside casing members.

An additional object of the invention is to provide a sliding window which is adaptable to permit changes in the number or type of sash used therein without the necessity of replacing any section of the supporting frame which is affixed to the window opening.

Still another object of the preferred embodiment of the invention is to provide a sliding window having framing assemblies which include a sash travelway means for guiding sash mounted therein and which sash travelway means may be snapped into or removed from sash travelway retaining means without moving said retaining means from either the window or pocket openings.

A further object of the preferred embodiment of the invention is to provide a sliding window having framing assemblies which include sash travelway means for guiding sash mounted therein which sash travelway means may be perpendicularly inserted or removed from sash travelway retaining means without the moving of said retaining means.

A further object of the invention is to provide a thermally improved sliding window construction and one which does not require skilled labor or special equipment for installation and futher which can be assembled on the job site and then installed in a building.

Another object of the invention is to provide a sliding window adaptable to utilize a wide selection of different types of sash, including some of different sash width, and which can be arranged in various combinations to accomplish a multiplicity of objectives.

The foregoing in various other objects, features and advantages of the invention will become more apparent and understandable as the description proceeds herein below, with reference taken to the accompanying drawings which illustrate, by way of example only, some preferred embodiments of the invention and in which like reference characters denote the corresponding parts of the several views.

DETAILED DESCRIPTION

Figure 1:
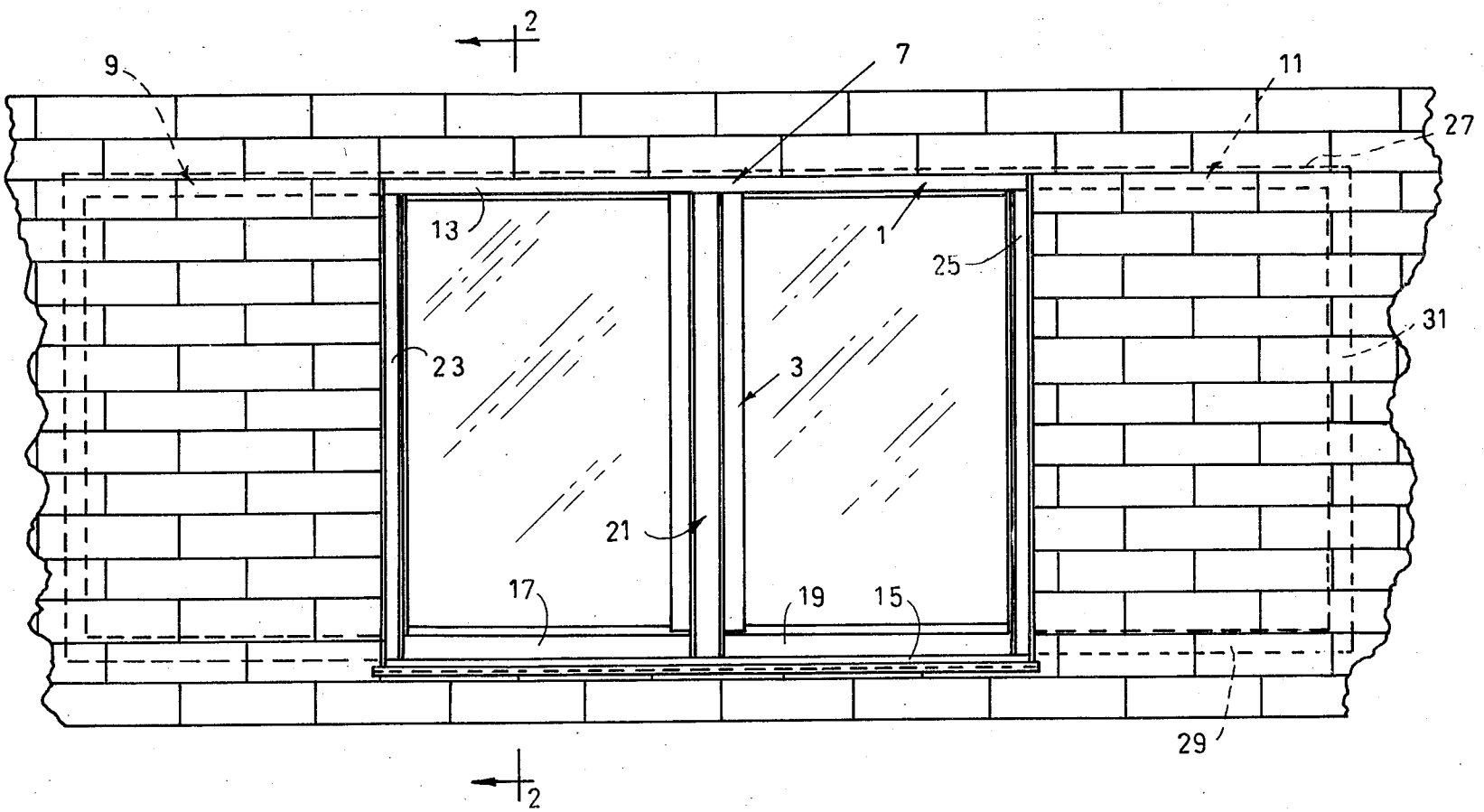
FIG. 1 is a simplified front elevational view of the pocket window embodying the present invention as seen from the exterior of a building structure into which the same is installed and wherein the pocket section installed in the walls of the building are shown in phantom view.

With particular reference to FIGS. 1 through 4, the pocket window assembly therein comprises a generally rectangular supporting frame unit 1 and a plurality of sash 3, four in number, not counting a screen sash 5, of sliding or rolling type mounted within the supporting frame 1 in parallel, closely spaced planes for relative horizontal movement. The supporting frame 1 includes a framing assembly generally comprising: a header framing assembly, comprising the top horizontal framing members; the sill framing assembly, comprising the lower horizontal framing members; and jamb framing assembly, comprising the vertical framing members. The supporting frame 1, which is intended to be set in the usual pocket and window receiving openings of a building comprises a centrally located double window frame unit 7 and a pair of pocket frame units 9 and 11 that extend, from the opposite sides of the window frame unit 7 into compartments or pockets formed within the wall of the building. The metal structural parts thereof are preferably formed of aluminum extrusions.

Figure 3:
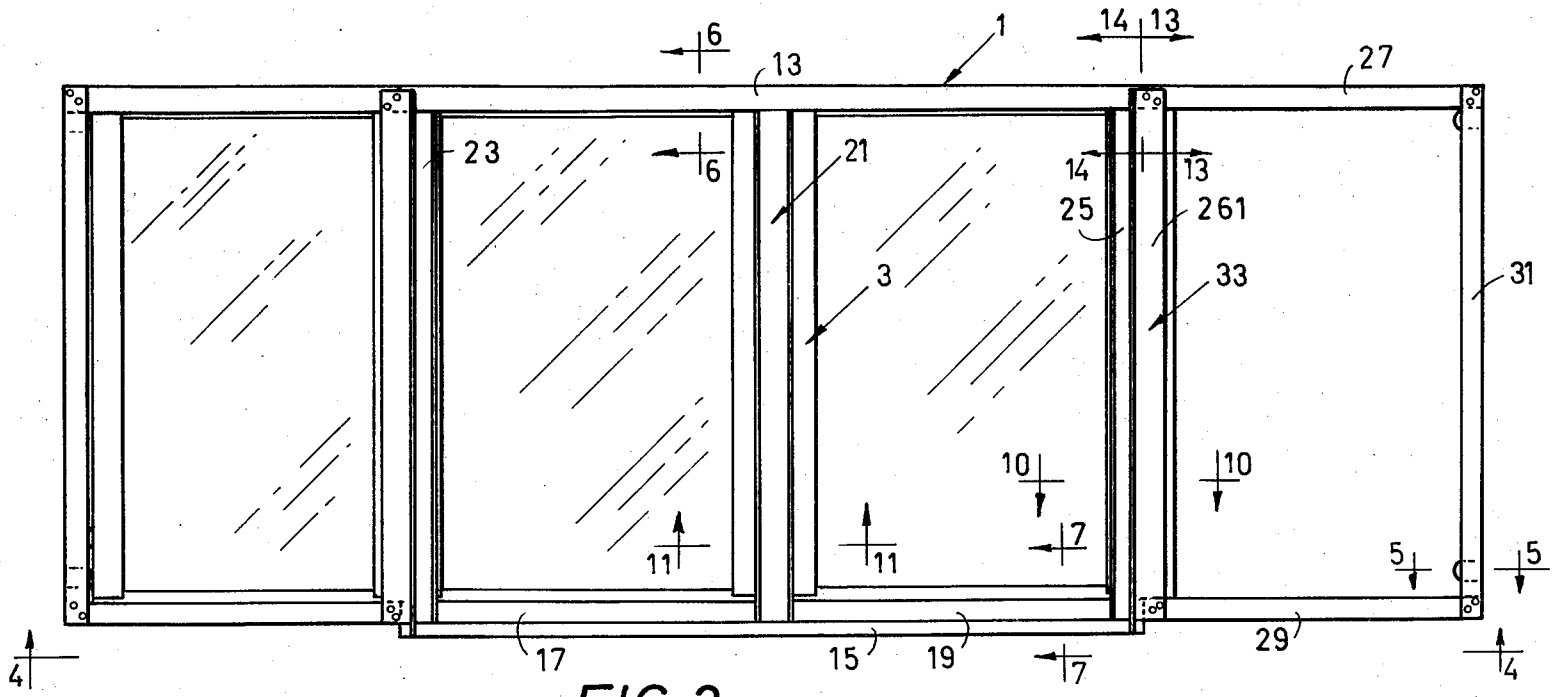
FIG. 3 is a simplified front elevational view of FIG. 2 taken along the line 3—3 of FIG. 2, and is similar to FIG. 1 but without the building structure within which it is installed and wherein sash are shown in an operative position across the window opening and disposed within the left pocket unit in an inoperative position.

The double window frame unit 7 whose width is equal to the longitudinal width of the window receiving opening consists essentially of a window header framing assembly, head assembly 13, a window sill framing assembly including a sill assembly 75 with a pair of window track retaining members 17 and 19, a window jamb framing assembly including a center post assembly 21, and a pair of window casing framing assemblies, casing assemblies 23 and 25. Each of the pocket frame units 9 and 11 consists essentially of a pocket header framing assembly, head assembly 27, a pocket framing assembly, pocket track sill assembly 29, and a pocket jamb framing assembly including a jamb 31 and closure assembly 33. The pocket frame units 9 and 11 as seen in FIG. 3, are preferably mirror images of each other. Also each individual window section of the double window frame unit 7, as seen in FIG. 1, is preferably a mirror image of the other. Thus a description of one of the pocket frame units 9 or 11 will suffice for both and corresponding parts will therefore carry the same reference numerals.

Figure 2:
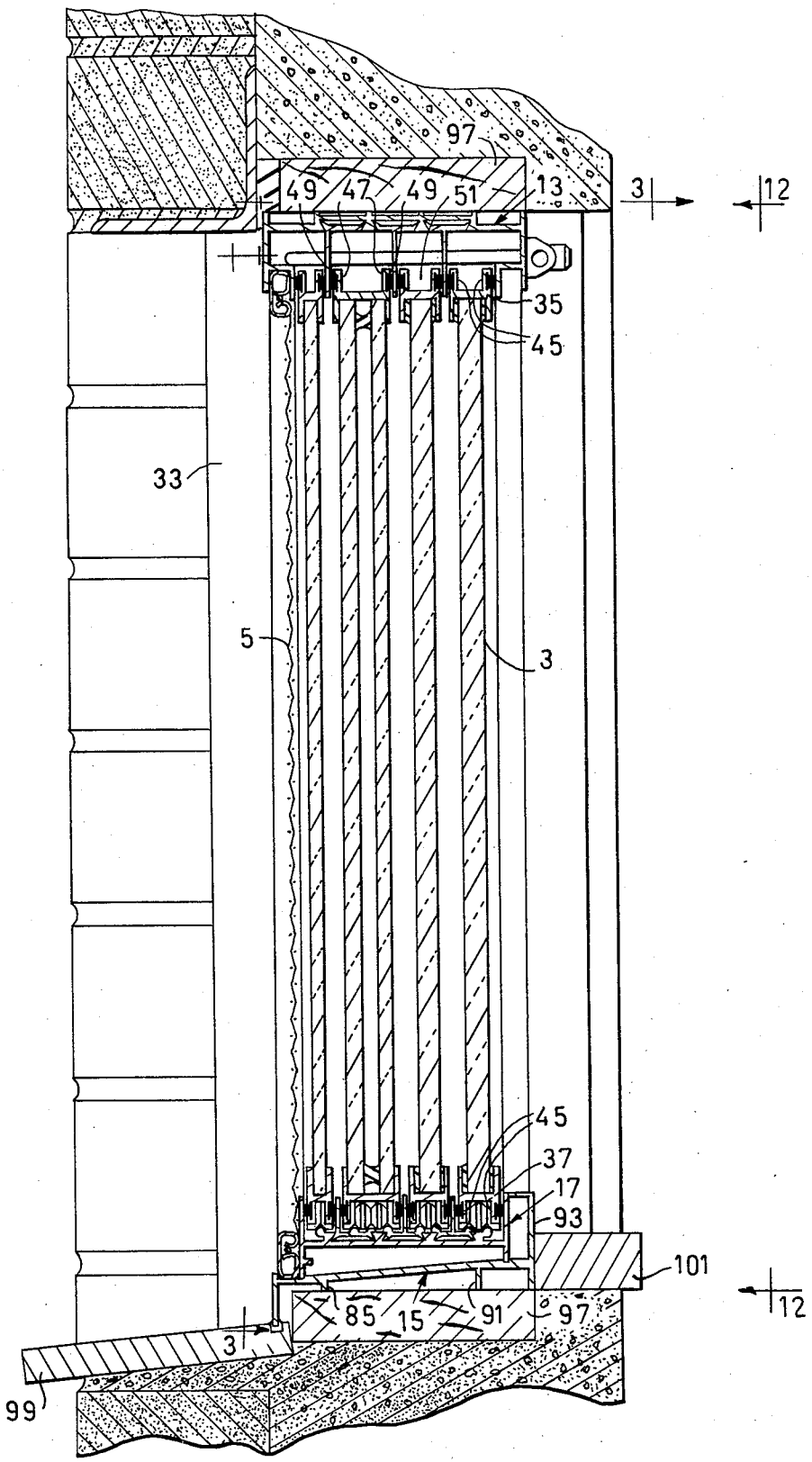
FIG. 2 is a cross sectional view of FIG. 1 taken along the line 2—2 of FIG. 1.
Figure 10:
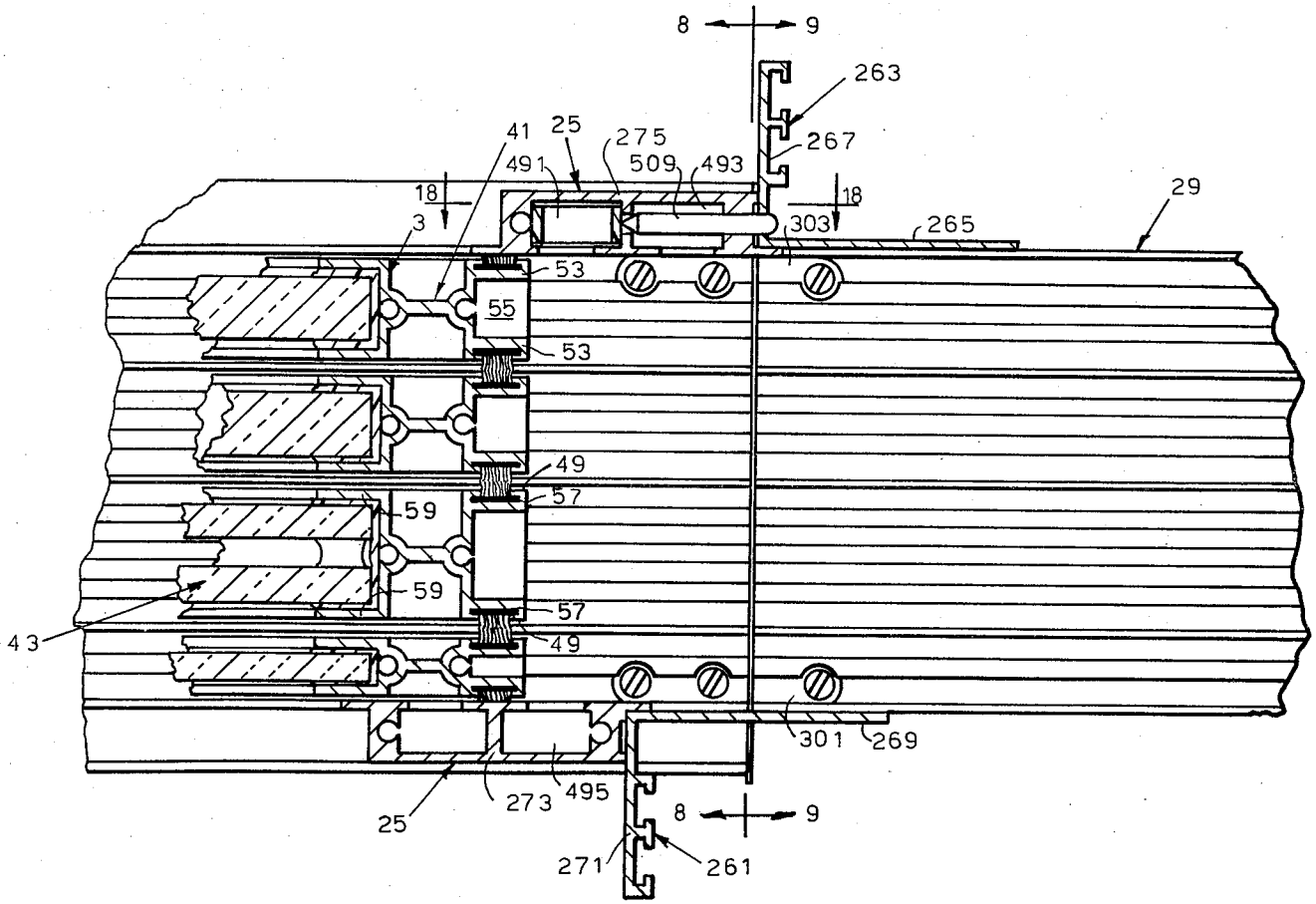
FIG. 10 is a simplified, sectional view of a lower portion of a right window and pocket units of FIG. 3 taken along the line 10—10 of FIG. 3.
Figure 19:
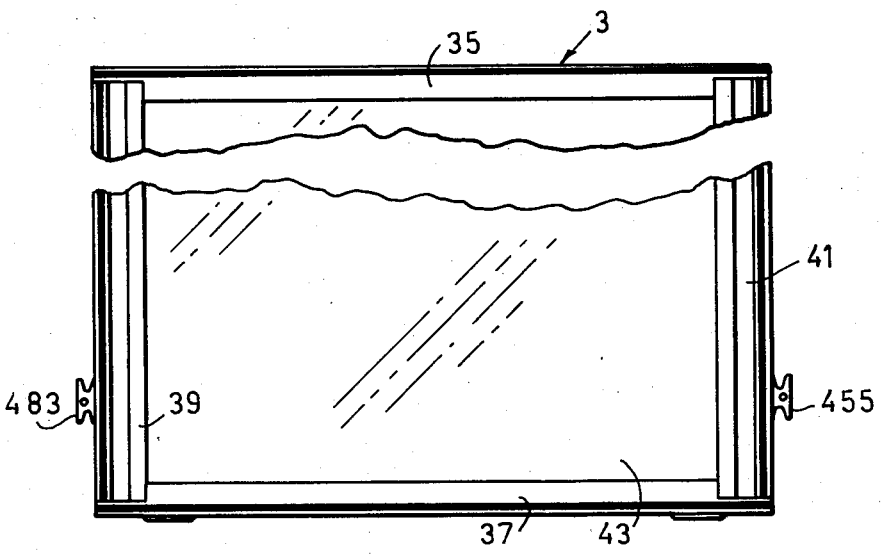
FIG. 19 is a partially broken, elevational view of one sash including its sash blocks.

In the preferred embodiment shown in FIG. 19 each sash 3 comprises a top horizontal header sash member 35, a bottom horizontal sill sash member 37, and a pair of opposite side vertical jamb sash members 39 and 41. Each sash 3 has conventionally set within its constituent members 35, 37, 39 and 41, by the use of conventional molding, a pane 43 or panel of glass or other desired suitable material. As seen in FIG. 2 the top and bottom horizontal header and sill sash members 35 and 37, respectively, of each sash 3 are H-shaped in cross section, and have a pair of outwardly projecting, parallel, and laterally spaced apart flanges or arms 45, extending upwardly in header sash member 35 and downwardly in the sill sash member 37. (see FIG. 2) Each flange 45 has an inner wall 47 and an outer wall 49, and at their facing inner walls 47 the flanges are adapted to define an outwardly opening channel 51 which extends throughout the complete length of the sash member 35 and 37. As seen in FIG. 10, the side vertical jamb sash members 41 of each sash 3 are also generally H-shaped in cross section and have a similar pair of outwardly projecting, parallel and laterally spaced apart flanges or arms 53 adapted to define outwardly opening channels 55 which extends throughout the complete length of each jamb sash member 41. The jamb sash members 39 and 41 are of the same construction and are mirror images of each other as viewed from the top thereof. Thus, a description of the jamb sash member 41 will suffice for the sash 39.

As best seen in FIG. 10 by reference to sash member 41, within longitudinally extending grooves 57 formed at the outside wall surface 49 of the outwardly projecting flanges 53 of all the sash members 35, 36, 39 and 41 of every sash 3 is a brush like sealing strip or weather stripping of suitable nonmetalic material which extends throughout the complete length of the flanges 53 and which extends laterally from said flange's 53 outer wall surface 49 a sufficient distance to form a weatherproof seal with the adjacent sash's sealing strip even without an insert member (discussed infra) being present therebetween, as for example when two adjacent sash are both present in the window opening or when they overlap one another as when one is located in the pocket opening and the adjacent sash is located in the window opening.

The inner portions of the top and bottom horizontal head and sill sash members 35 and 37, respectively, and side vertical jamb sash members 39 and 41, of each sash 3, have a pair of inner flanges or arms 59 (FIG. 10) adapted to mount within them conventionally gasketed edges of the pane 43.

Figure 7:
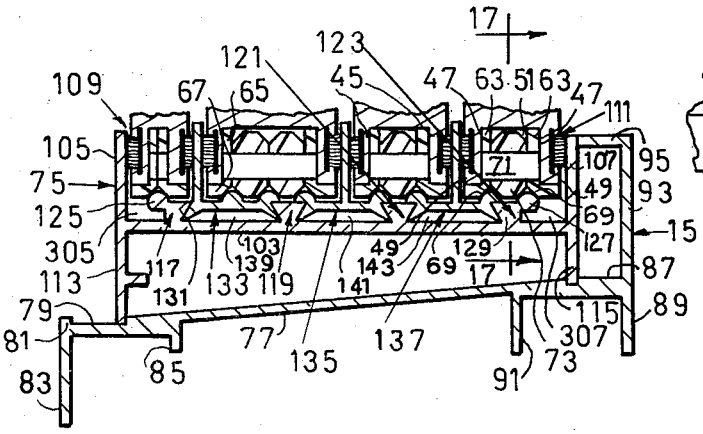
FIG. 7 is a sectional view of the right window's upper sill assembly and lower sill member, with a portion of its associated sash, of FIG. 3 taken along the line 7—7 of FIG. 3.
Figure 17:
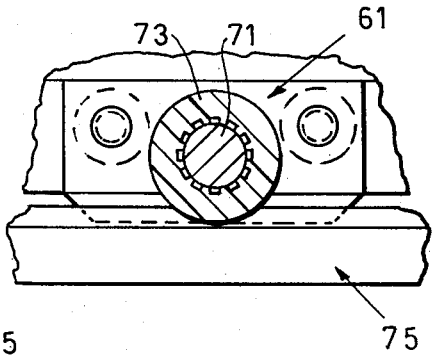
FIG. 17 is an enlarged sectional view of FIG. 7 taken along the line 17—17 of FIG. 7 showing the sill assembly of one sash and a portion of one upper sill assembly.

Referring now also to FIGS. 7, 19 and 17, the lower portion of the horizontal sill sash member 37 of the three right most sash as seen in FIG. 7 have a pair of roller assemblies 61 mounted thereon, each assembly 61 generally comprising a pair of oppositely disposed L-shaped slide blocks 63. Each block 63 has a vertical leg 65 which is attached to the inner wall 47 of one of the outwardly projecting flanges 45 and a horizontally extending leg 67 which abuts the lower edge of the flange 45 and extends to the juncture with the outer wall 49 of the flange 45. At the juncture of of the vertical and horizontal legs 65 and 67, respectively, of the slide blocks 63 an inclined surface 69 is formed and which slidably rests against a side of a rail forming member as will be evident subsequently. A horizontal pin 71 is mounted within apertures formed through the oppositely disposed vertical legs 65 of the slide blocks 63 of each assembly 61 and rotatably supports one or more rollers 73. Each one of the rollers 73 utilized is arranged between and supported on a pair of elongated spaced apart rails that form a travelway for horizontal movement of the sash. One of the sash 3, the left most one, as seen in FIG. 7 does not utilize rollers 73, but instead is provided with a pair of slide blocks 63 in an arrangement where the vertical legs 65 are contiguous and the inclined surfaces 69 rests against the opposite sides of the rail. Such a sash 3 without rollers 73 would be more appropriate for carrying a pane 43 of relative light weight, and is illustrated merely to show another type of support assembly that can be used with the rail components contemplated herein.

Figure 4:
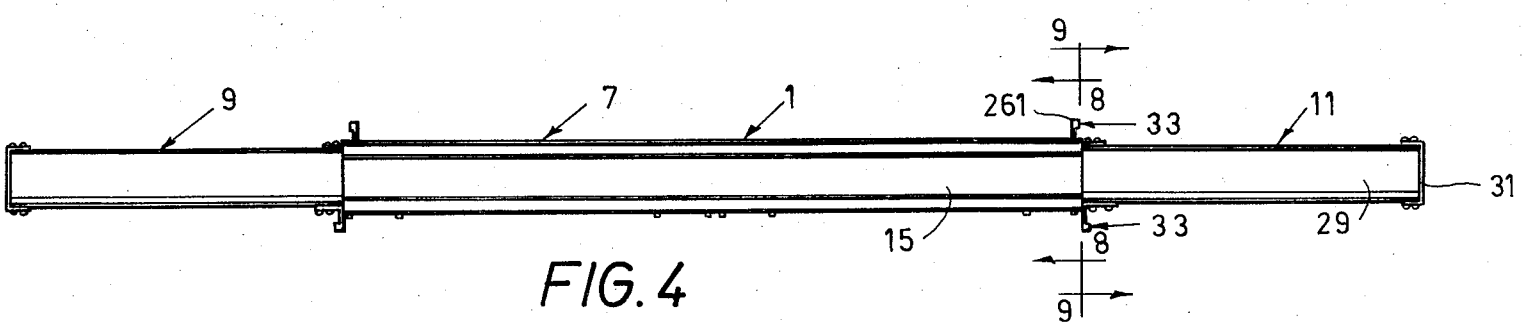
FIG. 4 is a simplified bottom plan view of FIG. 3 taken along the line 4—4 of FIG. 3.
Figure 5:
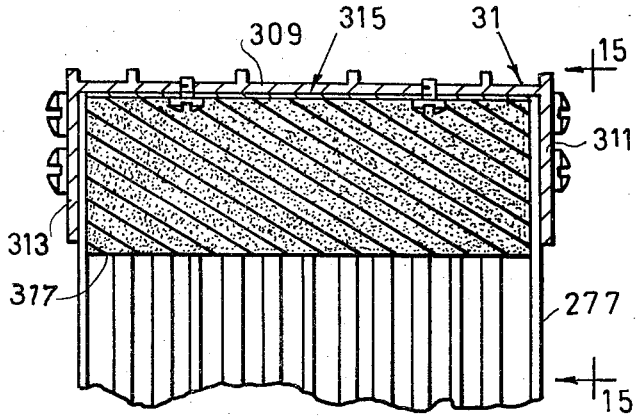
FIG. 5 is a sectional view of a portion of the right pocket's unit jamb and lower horizontal framing assembly of FIG. 3 taken along the line 5—5 of FIG. 3.

Each window track retaining members 17 and 19 is mounted on top of a lower, sill member 15 as best shown in FIG. 7 and both extend horizontally within the window receiving opening. The lower sill member 15 is a one piece unit as best shown in FIG. 4 and preferably has a cross section (FIG. 7) that includes a center portion 77 that is inclined downwardly toward the exterior of the building. The member 15 has an outer, horizontal, step portion 79 with an upstanding lip edge 81 and depending legs 89 and 91. A vertical flange section 93 extends upwardly at one end of a horizontal portion 87 of the member 15. This section 93 terminates in an arm 95 which extends horizontally inwardly and abuts window track retaining member 19. The lower ends of legs 85 91 and 89 are supported on the upper surface of a horizontally extending, wooden beam or buck 97 (FIG. 2). The outside leg 83 fits within a notch formed in the upper surface of an exterior sill 99, which extends horizontally within the window receiving opening and abuts the lower outside edge of buck 97. Abutting flange 93 and leg 89 at the interior side of the building wall is another sill 101 of rectangular cross section which extends horizontally within the window receiving opening.

Each window track retaining member 17 and 19 is horizontally arranged in the window opening, and extends between the window end of the adjacent pocket track sill assembly 29 and the center post inserts of the center post assembly 21. Each member, 17 and 19 is substantially H-shaped, and since the insert retaining member for each window is of the same construction and is a mirror image of the other, as viewed from the top thereof, a single description will suffice. Each of the members 17 and 19 includes a center section 103 which is horizontal arranged and a pair of upwardly extending side flange section, 105 and 107. The inner wall of the outside flange 105 forms one side of a sash channel 109 and the inner wall of the inside flange 107 forms one side of another channel 111. Disposed directly below flanges 105 and 107 are a pair of depending legs 113 and 115 which rest on the upper surface of the underlying sill member 15. Formed upon the upper surface of the center section 103 of each rail insert retaining, are a plurality of elongated laterally spaced and member parallel, upstanding ribs, 117, 119, 121 and 123 that have a coplanar arrangement and are coterminous with said center portion 77. The outermost and innermost ribs, 117 and 123, respectively, includes upper arcuate portions 125 and 127, respectively. These portions 125 and 127 form rails that are used in supporting the window sash. The coplanar arrangement of ribs 117, 119, 121 and 123 is such that adjacent ribs cooperate in defining an elongated shallow recess in the space therebetween and in which an insert member is retained. Ribs 119 and 121 cooperate in defining an elongated shallow recess 141 therebetween and each innermost rib also cooperates with one of the outermost ribs 117 and 127 in defining another recess, such as recesses 139 and 143.

Figure 8:
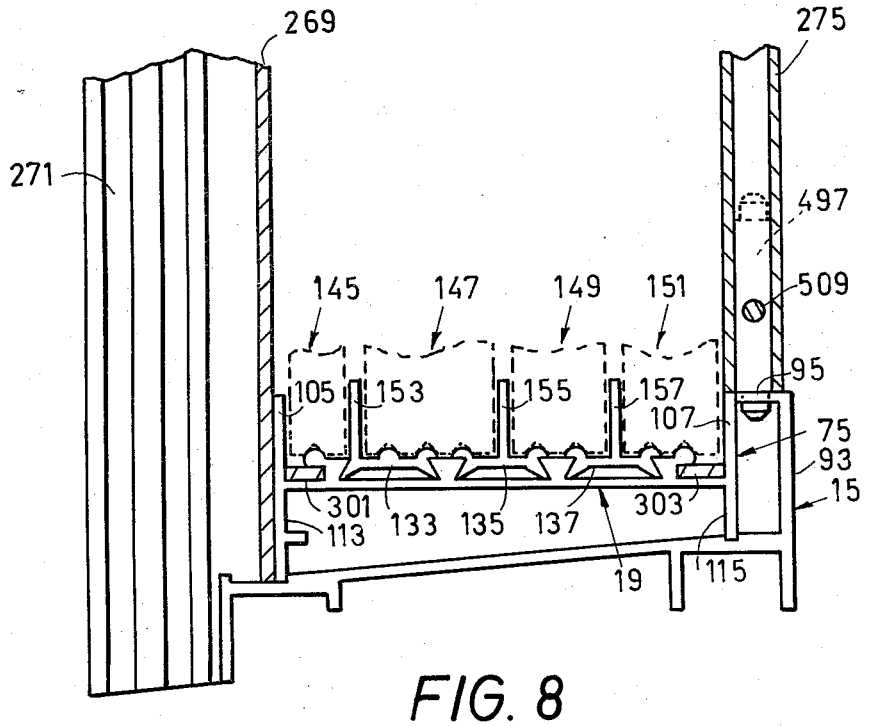
FIG. 8 is a sectional view of the upper sill assembly and lower sill member of the window unit, with portions of its associated sash shown in phantom view and a view of a portion of the outside closure member and inside casing assembly with its retainer block shown in phantom view, of FIG. 4 taken along the line 8—8 of FIG. 4.

FIGS. 2, 7 and 8 generally illustrate certain rail members 133, 135, and 137 which may be used as inserts in the retaining members 17 and 19 of the sill assembly 75 for supporting the sash. These inserts 133, 135, and 137 are of the slide-in type which are inserted in the retainer recesses at one end of the retainer before the retainer is secured to the lower sill member 15 of the assembly 75. As seen in FIGS. 7 and 8, the ribs of the retainer 19 cooperate in defining elongated shallow recesses 139, 141 and 143 which are dovetail in cross section. These inserts have elongated upright sections 153, 155 and 156 which are spaced apart and horizontally arranged in parallel with one another and with the upright flange sections 105 and 107 of retainer 19 of the assembly 75 so as to provide channels 145, 147, 149 and 151 for guiding the horizontal movements of the sash. These upright sections are spaced apart and arranged in pairs to straddle the lower ends of the sash. Sections 105 and 107 are integral parts of the insert retaining members, and sections 153, 155 and 157 are integral parts of the respective inserts 133, 135 and 137.

Figure 6:
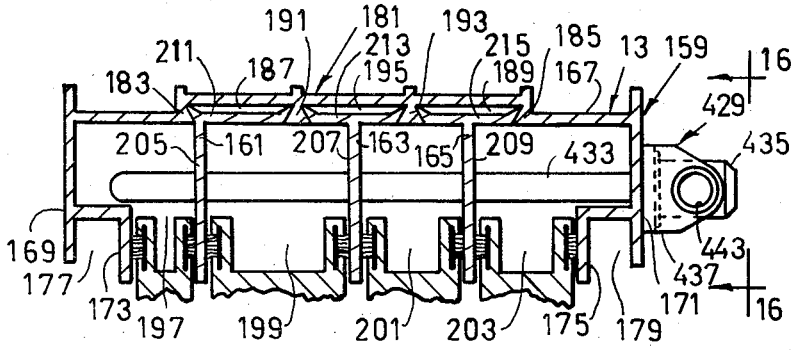
FIG. 6 is a sectional view of the left window's header assembly, including a portion of its associated sash and anti-lift pin assembly, of FIG. 3 taken along the line 6—6 of FIG. 3.

Referring now to FIG. 6, the window head assembly 13 basically comprises two sections, a window header track or a window header retaining, member 159 and a plurality of associated coacting, window head inserts 161, 163 and 165. The window header member 159, a single unit, extends horizontally within and completely across the window receiving opening and has a cross section that is generally U-shaped and includes a center section 167 which is generally horizontal and two downwardly extending flanges 169 and 171. Extending inwardly from the flanges 169 and 171 and near their lower ends are two L-shaped flanges, 173 and 175, respectively, which extends downwardly (into the window receiving opening) and each of which form an outside and inside channel 177 and 179, respectively, the former being suitable for receiving said screen sash 5. The lower surface of the center section 167 is slightly depressed and forms a central portion 181. At the edges of the central portion 181 inwardly diverging, longitudinally extending coterminous, wall portions 183 and 185 are formed and which, define one side of a groove, 187 and 189, respectively. This central portion 181 has also formed within it a plurality of downwardly extending, spaced apart, longitudinally extending, coterminous, ribs 191 and 193 which extend downwardly to the lower edge of wall portions 183 and 185 and together therewith defines adjacent sides of grooves or recesses 187, 195 and 189. The one piece header 158 is perferably fixed within the window opening and to its upper edge in a conventional manner and it and the bottom member 15 and rail inserts 17 and 19 are in vertical working alignment.

Referring to FIG. 6 again, slidably inserted and retained within the aforementioned coacting grooves or recesses, 187, 195, and 189, are a plurality of longitudinally extending, spaced apart, head insert members 161, 163 and 165 which cooperate with one another and the depending flanges 173 and 175 to form head sash channels 197, 199, 201 and 203, within which the header sash member of each sash 3 travels and are guided. Each head insert member 161, 163 and 165 basically comprise two sections, a vertical sash divider portion or guiding means, 205, 207 and 209, respectively, which together with the inside walls of the downwardly extending portion of flanges 173 and 175, forms the sides of adjacent head sash channels 197, 199, 201 and 203 and a horizontal base section 211, 213 and 215, respectively, which are of dovetail cross section at their ends and are retained within the aforementioned coacting grooves and will be described in more detail infra.

Figure 11:
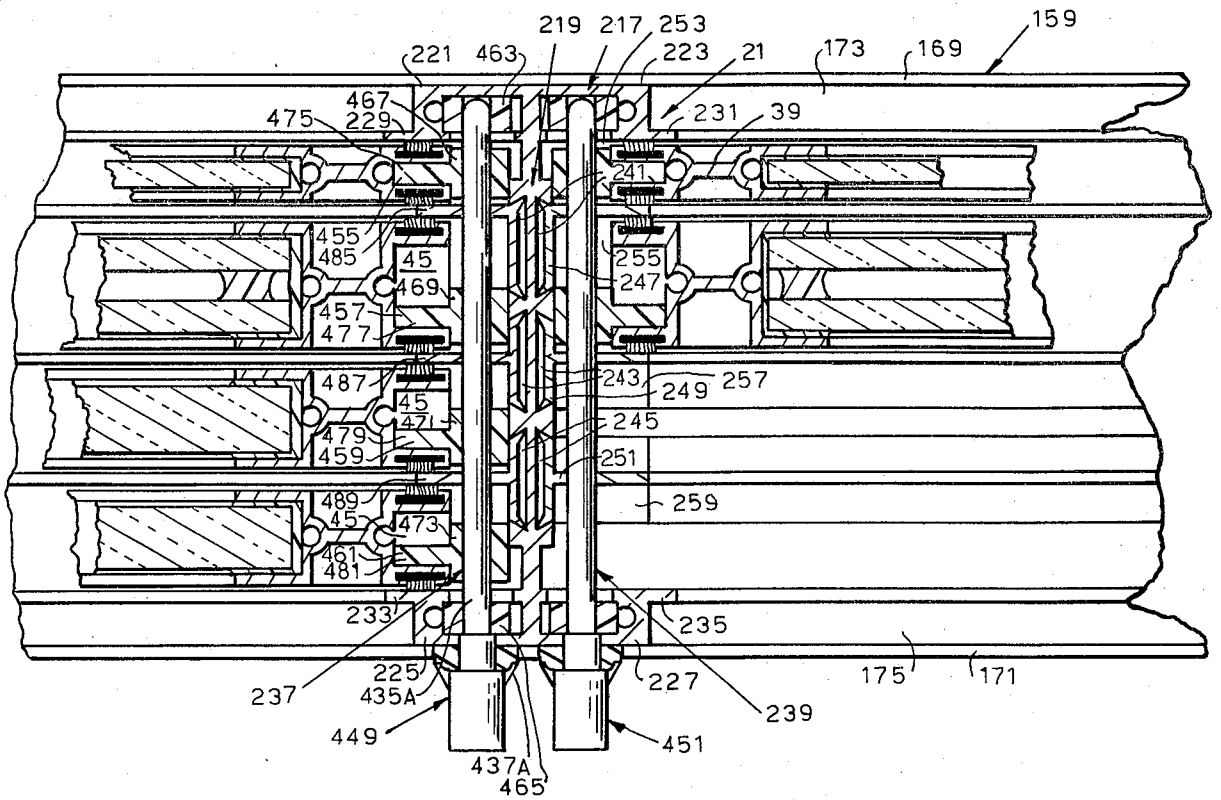
FIG. 11 is a simplified, sectional view of the center post assembly portion and view of a portion of the header of the window unit of FIG. 3 taken along the line 11—11 of FIG. 3 and additionally showing two lock-pin assemblies.

Referring now to FIGS. 3 and 11, the center post assembly 21 includes a vertically extending insert retaining member 217 and a plurality of inserts, such as designated at 247, 249 and 251 in FIG. 11. Member 217 is vertically oriented at the center of the window opening and depends from its attachment (not shown) to the one piece insert retainer 159 of the head assembly 13 to the top surface of the lower sill member 15. This retaining member 217 is generally I-shaped in cross section, as seen in FIG. 11, and has a vertical center section 219 which is arranged transversally of the window opening and provided with L-shaped side flange members 221, 223, 225 and 227 at the interior and exterior sides of the window. At its upper end, the flanges 225 and 227 of member 217 abut the interior side flange 171 of the insert retainer 159 of unit 7 while flanges 221 and 223 abut the exterior of side flange 169 of retainer 159. (See FIG. 11) At its lower end, member 217 extends between the exterior side lip 81 and the interior side flange 93 of the sill assembly 75. The ends of the flanges 221, 223, 225 and 227 have respective lips 229, 231, 233 and 235 which are offset from the center section 219 in an arrangement that accommodates the mounting of a pair of window lock pins 237 and 239 on member 217, as will be subsequently described. The center section 219 has a plurality of recesses, such as indicated at 241, 243 and 245, and which are formed by spaced apart ribs at the opposite sides of the center section, as seen in FIG. 11. The recesses are arranged to receive channel defining inserts, such as inserts 247, 249 and 251 during the assembly of the center post. These inserts are slidably inserted in the recesses at one end of the member 217 during the assembly of unit 7 and each insert is equipped with an outwardly projecting section that cooperates in forming one of the channels 253, 255, 257 and 259 in which the vertical sash members 39 are received at the closed positions for the sash.

The closure assemblies 33 for the wall pocket frame units are illustrated in FIGS. 3, 4, 8, 9 and 10 by reference to the structure of the closure assembly for frame unit 11. Assembly 33 comprises a pair of L-shaped members 261 and 263 which are mounted at the exterior and interior sides of the window opening. The interior member 263 includes a first section 265 which fits completely within the wall pocket and is attached at its top end to pocket header 27 and near its lower end to pocket track sill assembly 29. Its second section 267 is preferably fixed within the window receiving opening and to the outer edge of the adjacent building wall structure in a conventional manner. The exterior member 261 includes a first section 269 which fits partially within the wall pocket and therefrom extends into the window receiving opening whereat it is attached at its upper end to pocket header 27 and is attached near its lower end to pocket track sill assembly 29. Its second section 271, extends perpendicular to the first section 269 and abuts against one side of an outer section of the adjacent casing assembly 25. The closure assemblies 33 for units 9 and 11, as seen in FIGS. 3 and 4 are preferably mirror images of each other. Thus, a description of one will suffice for the other.

The structure of the casing assemblies 23 and 25 for the double window unit 7 is best seen in FIGS. 1, 3, 8 and 10 by reference to assembly 25. Assembly 25 comprises an exterior member 273 and an interior member 275. Each member 273 and 275 is generally E-shaped in cross section and is attached and arranged to extend vertically between the retaining member 159 of the head assembly 13 for unit 7 and the lower sill member 15 for the unit.

Figure 9:
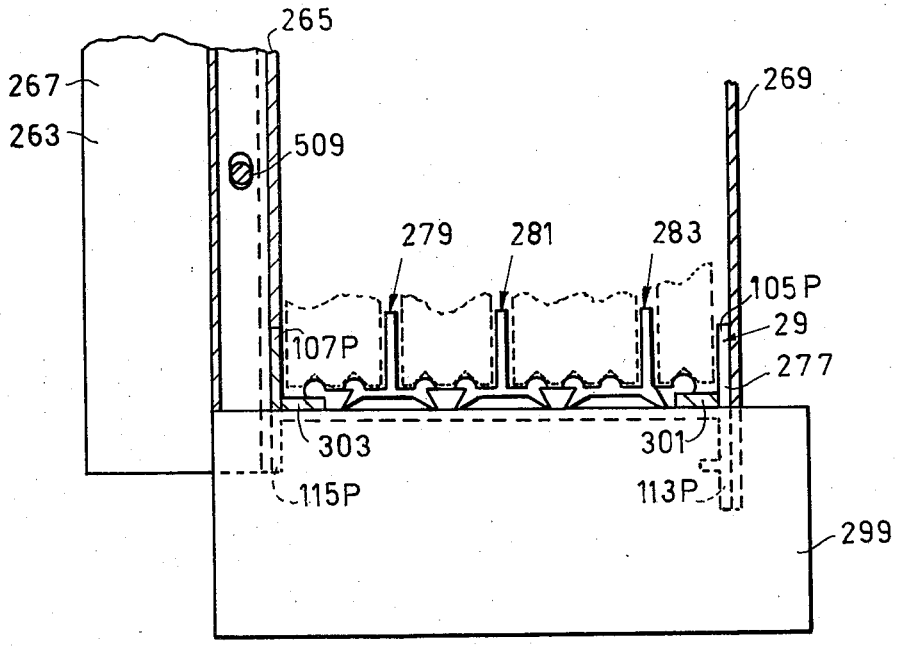
FIG. 9 is a view of the right pocket's lower horizontal assembly, the dam, a portion of the inside closure member and a portion of associated sash shown in phantom view and a sectional view of a portion of the outside closure member of FIG. 4 taken along the line 9—9 of FIG. 4.

As illustrated in FIG. 3, each of the pocket frame units 9 and 11 comprises a pocket head assembly 27 (see FIGS. 1, 3 and 13), a pocket sill assembly 29 (see FIGS. 1, 3, 4, 9 and 10), a jamb assembly 31 (see FIGS. 1, 3, 5 and 15), and a closure assembly 33 (see FIGS. 3, 4, 8, 9 and 10). Referring now to FIG. 9, the sill assembly 29 basically comprises an elongated insert retaining member 277 and a plurality of elongated insert members 279, 281 and 283.

Referring to FIGS. 8 and 9, it will be seen that the insert retaining member 277 and the inserts 279, 281 and 283 of assembly 29 are, except for length, identical to the insert retaining members 17 and 19 and the track inserts 137, 135 and 133 of sill assembly 75. As such, the previous description will suffice therefor. Parts of the wall pocket insert retainer 277 which correspond to the same parts of the window insert retainers 17 and 19 carry the same reference numeral with a suffix P added.

Figure 13:
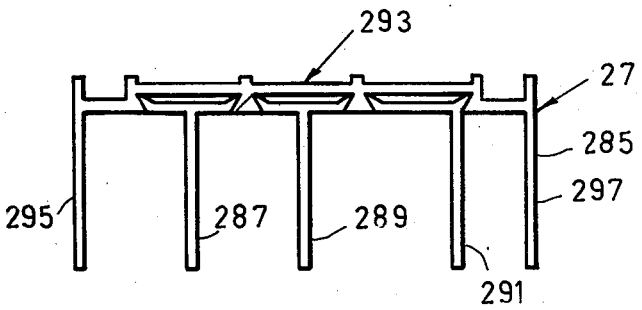
FIG. 13 is a view of the right pocket header assembly of FIG. 3 taken along the line 13—13 of FIG. 3.

Referring now to FIG. 13 each of the pocket head assemblies 27 basically includes, a pocket header track retaining member 285 and a plurality of head inserts 287, 289 and 291. The pocket member 285 includes a center section 293 and a pair of depending, flanges 295 and 297. Now referring to FIG. 14, it can be seen that each head assembly 27 is substantially similar to the window head assembly 13 (also shown in FIG. 6). The center sections 181 and 293 of members 159 and 285 and the head inserts 161, 163 and 165 and 287, 289 and 291 of members 159 and 285 are identical in cross section but the width of the pocket header member 285 is narrower than that of member 159 so as to fit within the pocket opening formed in the wall of the building. Accordingly, the downwardly extending side flanges 295 and 297 of member 285 are closer together than are the corresponding flanges 169 and 171 of member 159 and they lack structure that corresponds to the L-shaped channels 173 and 175 of member 159. Furthermore pocket head flanges 295 and 297 are spaced apart the same distance as are the vertical portions of window head track flanges 173 and 175.

Section 265 of interior member 263 of assembly 33 is attached near its top end to the outer side of flange 295 of pocket header retaining member 285 and attached near its lower end to the outer side of flange 107P of insert retainer sill 277, as best seen in FIG. 9. Additionally the portion of the section 269 which fits within the wall pocket (FIG. 10) is attached at its upper end to the outer side of flange 297 of member 285, as best seen in FIG. 13, and is attached near its lower end to the outer side of flange 105P of sill member 277, as best seen in FIG. 9. These attachments are made in a conventional manner as by utilizing two horizontally extending screws at each attachment point.

A sill dam plate, 299, as best seen in FIG. 9, of rectangular shape is conventionally attached to the lower front end of each pocket opening and extends between the adjacent pocket and window sill insert retaining members 19 and 277, respectively, to provide a means for sealing those portions of the pocket from adverse weather conditions.

To properly line up and connect the adjacent horizontal insert retaining members 19 and 277 a pair of track liner plates 301 and 303 are moved within registering grooves 305 and 307, (FIG. 7) of the pocket and window sill tracks 75 and 277, respectively, to span both tracks and are then conventionally attached thereto.

Figure 15:
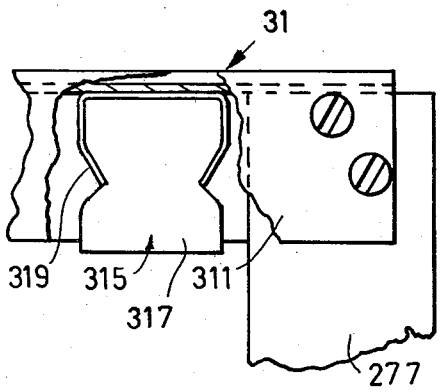
FIG. 15 is an elevational view, partially broken away and sectional, of FIG. 5 taken along the line 15—15 of FIG. 5.

The pocket jamb assembly 31 includes an elongated vertically extending U-shaped member 315 which has opposite side flange sections 311 and 313, and a pair of resilient members 317 which are vertically spaced apart (see FIG. 3) and located between the flange sections 313 and 315. Here the resilient members are suitably secured to the center portion 309 of member 315. Member 315 extends between the insert retaining members 275 and 285 of the sill and head assemblies 277 and 285 and is attached to the opposite side flanges of the insert retainers 277 and 285 by screws as illustrated in FIG. 15.

Figure 21:
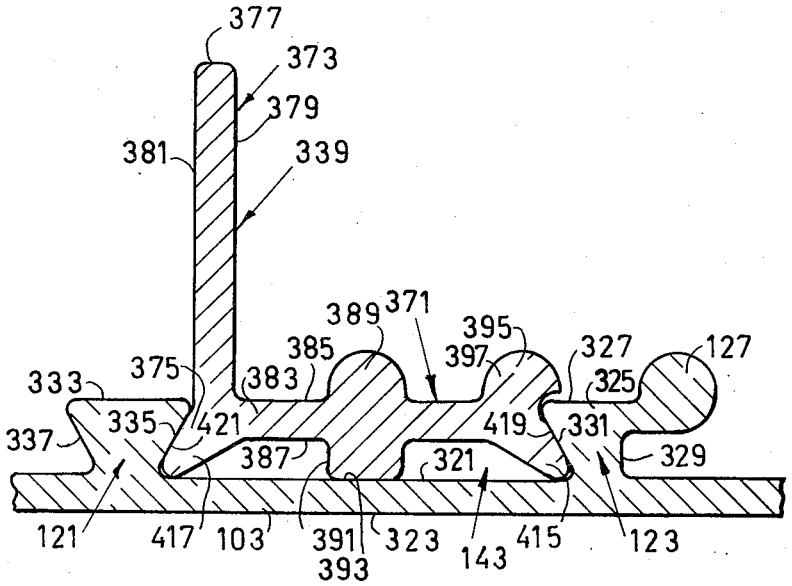
FIG. 21 is an enlarged, end elevational view, of the L-shaped type of slide in sash travelway and a portion of its associated coacting retaining means.

Referring now to FIG. 21 and 7, FIG. 7 specifically illustrates a portion of a track or insert retaining member used for the slide in type of insert and includes a bottom, horizontally extending center section 103, of rectangular shape in cross section, and having planar upper and lower wall surfaces 321 and 323, respectively, and which extend longitudinally. A plurality, four, in the embodiment illustrated in FIG. 7, only two of which are shown in FIG. 21, of laterally, spaced apart and upright ribs 121 and 123, are formed on the upper wall surface 321 of center section 103, and which extend longitudinally and coterminous with said center section 103. The outermost rib 123 and the innermost rib (not shown in FIG. 21, but shown in FIG. 7 as element 117) has an upper extension portion 127 of generally circular shape, in cross section, which laterally projects from a lower, main portion 325 of the rib 123. This round extension portion 127 forms a rail member or rail means. The main portion 325 is generally of trapazodial shape, in cross section, and has an upper flat edge 327 and a vertical outside wall 329, which integrally connects, with said rail 127. An inner planar wall 331 inwardly diverges toward the upper surface 321 of center section 103 at about 60 degrees to the horizontal to form one side of a coacting groove of dovetail cross section. Laterally spaced from the main portion 325 of outside rib 123 and parallel thereto is rib 121, which is generally of V-shaped, in cross section, having an upper flat edge 333 which is in the same plane as edge 327, and therefore coplanar therewith and two planar sidewalls 335 and 337, together with that portion of the upper wall surface 321 which is between said sidewalls 335 and 331, forms or defines a groove 143 in which slide in insert 339 is retained. Rib member 121 and the other inner rib member 119, as well as the corresponding main portion, 325, of outermost rib 123 (and the corresponding main portion 131 of innermost rib 117) function as track dividers and enable the inserts to be retained.

Figure 22:
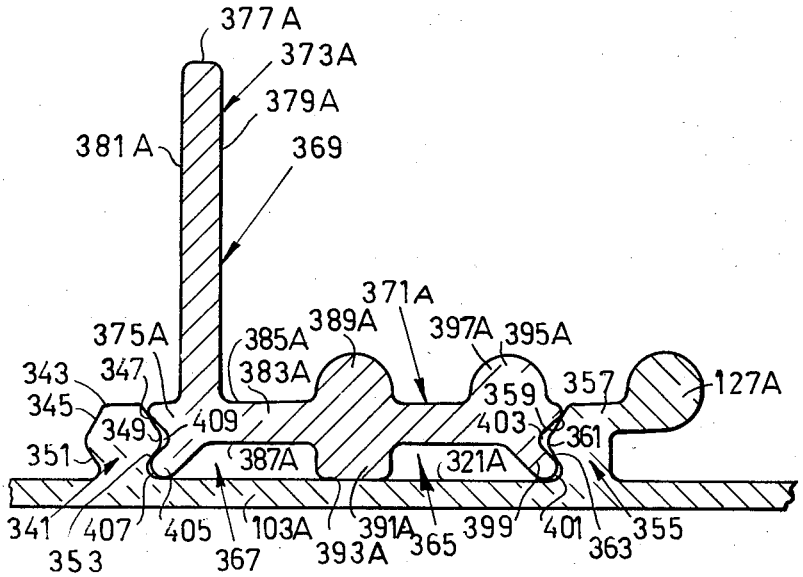
FIG. 22 is an enlarged, end elevational view, of the L-shaped type of snap in sash travelway and a portion of its associated coacting retaining means.

Referring now to FIG. 22 which illustrates a portion of the preferred embodiment of the insert retaining member used for the snap in type of inserts, and using the same numbers with the suffix A added for those parts which correspond to the same parts used in the slide in type or track, it can be seen that the center section 103A of the snap in track is the same as the slide in track, except for the shape of the ribs and recesses. The inner rib 341, is generally of pentagonal shape, in cross section, having an upper flat edge 343 and two planar, upper inclined sidewalls 345 and 347 each of which diverges outwardly in a downward direction from the ends of upper edge 343 at about 30 degrees from the vertical and terminate and forms a shoulder, 349, at a point about halfway down the height of the rail 341 and adjoins, respectively, two planar lower inclined walls 351 and 353 each of which converges inwardly in a downward direction toward the upper surfaces 321A of center section 103A at about 60 degrees to the horizontal. The outermost rib 355 has an extension portion 127A which is identical to the corresponding portion of the slide in track and has a lower, main portion 357 which is substantially identical, in cross section, to the left half of the rib 341 as viewed in FIG. 22. The rib 355 includes an outwardly inclined upper sidewalls 359, shoulder 361 and a lower inwardly inclined sidewall 363 thereby forming a recess 365 that is defined by and in the space between the ribs 341 and 355.

Figure 23:
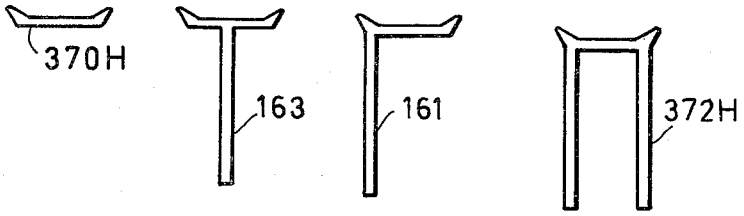
FIG. 23 is an end elevational view of the four type of slide in sash travelways used in all the header retaining means in the pocket and window units.
Figure 24:
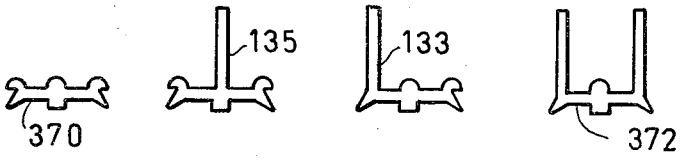
FIG. 24 is an end elevational view of the four type of slide in type sash travelways used in all the pockets lower horizontal retaining means and window sill retaining means.

Referring now to FIG. 22 wherein the details of a snap in insert member, of the L-shaped type, is illustrated and in FIGS. 23 and 24 wherein all four types of two groups (sill and header) are illustrated, and using the same numbers with the suffix H added for those inserts which are used in the header and which were not previously otherwise referred to, namely; horizontally oriented generally I-shaped members 370 and 370H, generally T-shaped members 135 and 163, generally L-shaped members 133 and 161, and generally U-shaped members 372 and 372H. There are three groups of inserts: the first group is used in the top horizontal framing members (pockets and window header insert retaining members 285 and 159, respectively); the second group is used in the lower horizontal framing members (pocket and window sill insert retaining members 277 and 19 or 17 respectively); and the third group (not shown in FIGS. 23 and 24) is used in the vertical framing members (the vertical jamb insert retaining member 217 of the center post of assembly 21) All of the inserts for the sill insert retaining members 17 and 19, window header insert retainer 159 and center post retainer 217 as well as for the pocket sill insert retaining member 277, pocket head insert retaining member 285, of each group, are indentical in shape and width except for the presence or absence of rails and stiffners and each of the three groups of inserts otherwise differs from the other groups only in their height and their overall longitudinal length. Also, referring specifically to FIG. 24, only the inserts 370, 135, 133 and 372 used in the sill assemblies 75 and 29 include rails and stiffners. The inserts 370H, 163, 161 and 372H, illustrated in FIG. 23 are used in the head assemblies 13 and 27. Those used in the center post retainer 217 are not shown but are identical in shape to those used in the head assemblies except that their height is slightly greater. The inserts used in the head and center post assemblies do not include rails or stiffners. The horizontally oriented I-shaped members, 370 and 370H, are "blank" that is, they are used when a sash is not desired to be used in the channel. The T-shaped insert members 135 and 163 can be used in the track to form the adjacent sides of two channels, the L-shaped members or "edge" members 133 and 161 can be used in the tracks to form the adjacent sides of two channels, and the U-shaped members, or "double" inserts 372 and 372H can be used in any of the tracks to form both its own channel and the sides of adjacent channels. By utilizing such inserts, in various combinations, up to six sash, not counting the screen sash, can be utilized in the preferred embodiment, although four sash are shown in the embodiment illustrated, three sash being of different widths.

Referring now specifically to FIGS. 21 and 22, only one of each type of insert member, the snap in and slide in varieties, namely the L-shaped one, 369 and 339 of a group of the same types of inserts, is described in detail, since the L-shaped insert members 369 and 339 include all the constituent elements making up the other three inserts of each type (as well as each group) and are of the same dimensions when used in corresponding tracks. The same numbering system as used with the slide in and snap in tracks is utilized; that is the suffix A is added to those parts of the snap in insert which corresponds to the same parts of the slide in insert. Each insert is also elongated and longitudinally extending, and the L-shape members 369 and 339, in cross section, includes a generally horizontal base section 371 and a vertical or upright section which is an integral part of the insert is joined to the base section 371 at the top of one side portion 375 of the insert. The vertical or upright section 373 is generally rectangular in cross section with a flat upper edge 377 and planar side walls 379 and 381. As mentioned previously this upright section 373 functions as a sash divider and guiding means which with another upright section of another retainer or retaining member in the sill assembly defines a channel within which the sash can travel and within which they are guided and maintained. The lower portion of the vertical section 373 is integral with the base section 371 and extends perpendicular thereto. The base section 371 generally extends horizontally and includes a main section 383 which is generally rectangular, in cross section, having generally flat upper and lower surfaces, 385 and 387, respectively. Intermediate the main section's, 383, ends, and protruding from upper surface 385, is an upstanding arcuate shaped portion 389 which forms a rail member for use in supporting the sash. On the top of the other side portion 395 of the base section 371 another rail member 397 is formed.

Located directly below rail 389 and extending vertically downwardly from said lower surface 387, is a generally rectangular shaped, in cross section, member 391 having a generally flat lower edge 393. This member 391 functions as a support or stiffner member for the rail member 389.

The L-shaped snap in type of insert 369 also has a side portion 395A, which is equipped with another upstanding rail forming arcuate portion, 397A. The lower part of this side portion 395A, has a lower, outwardly projecting leg portion 399 which is equipped with a planar wall 401 that is inclined at about 45 degrees with respect to the horizontal main section 383A and merges with a laterally opening notch 403 in the side portion 395A. The lower portion of the other side portion 375A is a mirror image of the lower portion of side portion 395A and includes a leg 405, inclined planar wall 407, and notch 409. Due partially to the shape of the notched opposite side portions 375A and 395A the insert can be flexed and snapped into the recess 365. Specifically the snap in type of insert 369 is inserted into the recess 365 by placing the lower end of one side (i.e. side 395A) of the base portion 371A in the recess 365 so that its legs 399 rests against sidewall 363 and the lower end of the other side portion 375A is in the upper half of the recess 365 with its leg 405 resting against sidewall 347. Downward pressure, applied by the arm of the installer, near the higher side (375A) of the base portion 371A flexes and snaps the leg 405, past the shoulder 349 and into the bottom of the recess 365. as the leg 405 enters the bottom of the recess 265, the base section 371A returns to its normal shape thereby engaging all four sidewalls that confronts the recess 365. Thereafter the insert is retained in the groove by the inclined sidewalls 353 and 363 of ribs 341 and 355.

The slide in type of insert, 339, illustrated in detail in FIG. 21, is almost completely identical in shape to the snap in type of inserts 369 illustrated in FIG. 22 except for the lower parts of the opposite side portions 395 and 375. The lower parts of side portions 395 and 375 are generally V-shaped in cross section and each includes an outwardly projecting leg portion 415 and 417. Each side portion 395 and 375 has a lower planar wall inclined at about 30 degrees with respect to the main, generally horizontal section 383, and an upper planar wall 419 and 421 which is inclined at about 60 degrees. The base section 37 is generally dovetail shape and is slidably inserted and retained within an associated dovetailed recess 143 that is located between inclined walls 331 and 335 and defined by ribs 121 and 123. This type of insert can only be slidably inserted into its recess 143 at one end of its track whereas the snap in type of insert can either be snapped or slid into its associated groove 367. Since only the inserts used in the lower horizontal tracks include rails, the others, with the exception of the blanks, will have a base section 371 with a completely planar upper surface except for any perpendicularly extending upright section 373 which is an integral parts of the insert.

Figure 16:
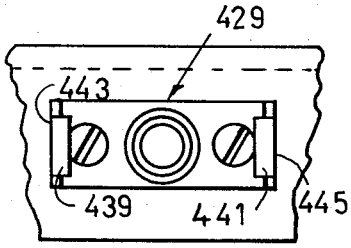
FIG. 16 is an elevational view of FIG. 6 taken along the line 16—16 of FIG. 6 and showing a portion of the anti-lift pin assembly.
Figure 12:
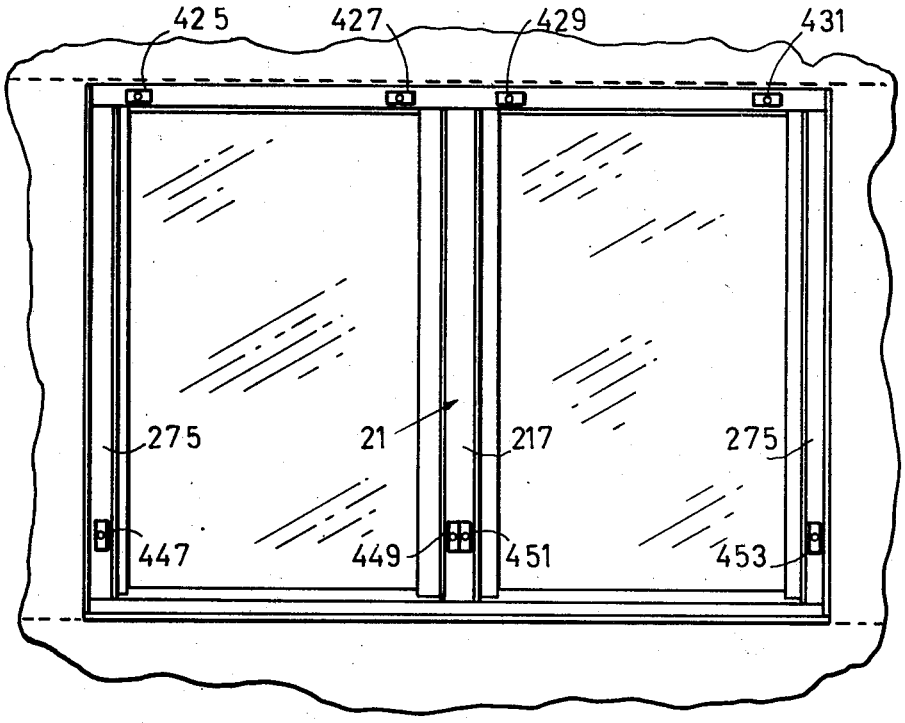
FIG. 12 is a simplified rear elevational view of the window unit of FIG. 2 taken along the line 12—12 of FIG. 2 showing the window unit from the interior of a building structure.
Figure 14:
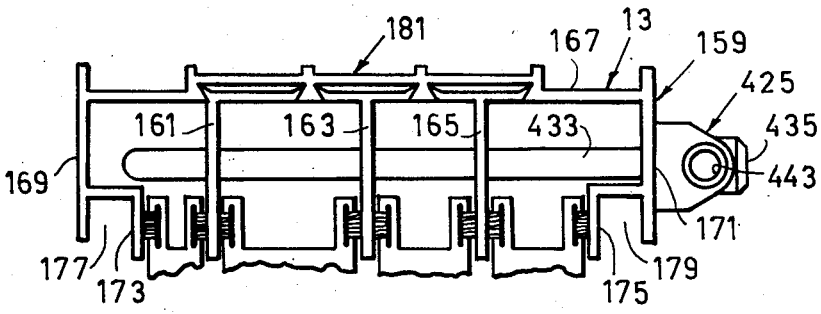
FIG. 14 is a view of the right window's header assembly and a portion of its associated sash of FIG. 3 taken along the line 14—14 of FIG. 3 and additionally showing an anti-lift pin assembly.

Referring now to FIG. 12, there is generally illustrated four identical anti lift pin assemblies, 425, 427, 429 and 431, located in the window header assembly 13, two for each window. As these anti lift pin assemblies are all identical a description of one individual assembly will suffice for all and corresponding parts will therefore carry the same reference numerals. These anti lift pin assemblies are utilized to prevent their associated sash from accidentally being removed during operation; while sliding past each other. Referring now specifically to FIGS. 6 and 16 anti lift pin assembly 429 comprises a horizontally extending rod member 433 having a knurled end to which a knob 435 is pressably attached to and which has a threaded shoulder on its inner portion. A bracket 347, which is generally U-shaped in cross section, and having a centrally located threaded aperture is preferably attached to the inside window header track flange 171 by conventional means as by utilizing two screws. Rod member 433 is then inserted through the brackets' 437 central aperture and apertures formed in the header flange 171 and all the header inserts 205, 207 and 209 and is secured into place by engaging the threaded shoulder of knob 435 in the threaded aperture formed in bracket 429. Bracket 437 also includes, at its end, two laterally projecting flanges 439 and 441 each of which has an aperture 443 and 445, respectively formed therethrough; the rod 435 can be placed through them conviently and stored therein when the sash is desired to be removed. FIG. 14 illustrates the anti lift assembly 425 in a slightly different manner, the view taken at the very end of the window opening where the pocket begins.

Figure 20:
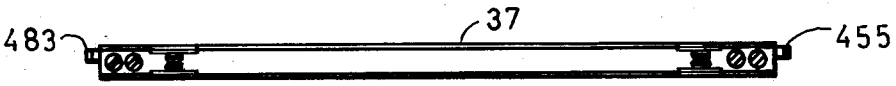
FIG. 20 is a bottom plan view of the sill sash assembly of the sash of FIG. 19.

Referring now to FIG. 12, four identical lock pin assemblies 447, 449, 451 and 453 are generally shown, two, 449 and 451, located adjacent each other near the lower end of the inner side of inside casing 275. As these lock pin assemblies are all identical a description of one individual assembly will suffice for all and corresponding parts will therefore carry the same reference numerals. Referring now specifically to FIG. 11, each lock pin assembly is similar to the previously described anti lift pin assemblies 425, 427, 429 and 431, and includes several additional elements; lock pin sash block 455, 457, 459 and 461, four for each assembly, and two lock pin guide blocks 463 and 465. The same numbers with the suffix A added is used for those parts which correspond to the same parts used in the anti lift pin assemblies. The guide blocks 463 and 465 are generally rectangular and have a central aperture therethrough and are located in the recesses formed by the L-shaped flanges 221, 223, 225 and 227, of the center post retaining member 217. The lock pin sash blocks 455, 457, 459 and 461 are generally T-shaped, in cross section, as shown in FIG. 11 and each has a centrally located aperture in a vertically extending portion 467, 469, 471 and 473, respectively, as seen in FIG. 11. A horizontally extending portion 475, 477, 474 and 481 of the T-shaped sash blocks 455, 457, 459 and 461, respectively, extends into each jamb sash channels 45 and is preferably attached, in a conventional manner, to at least one inner wall of flange 53 of vertical, jamb sash member 41 of its associated sash 3. As best shown in FIGS. 19 and 20, each sash 3 has two sash blocks 455 and 483 connected to it, one each attached near the lower end of each vertical lamb sash member 41 and 39, respectively.

Rod 435A of lock pin assembly 449 is then inserted through apertures formed in the bracket 437A, sash blocks 461, 459, 457 and 455, and associated jamb inserts, 485, 487 and 489 to lock one side of the sash 3 in place within the window opening. The other side of the sash 3 may be locked in place, if desired, when all sash are in place within the window opening by utilizing the same lock pin assembly located generally between the two inside and outside casings, 275 and 273, respectively, and more specifically the lock pin rod 435A extends through a first recess 491 formed in the E-shaped inside casing, which also includes a second recess 493 and into another first recess 495 formed on outside casing 273, as best seen in FIG. 10.

Figure 18:
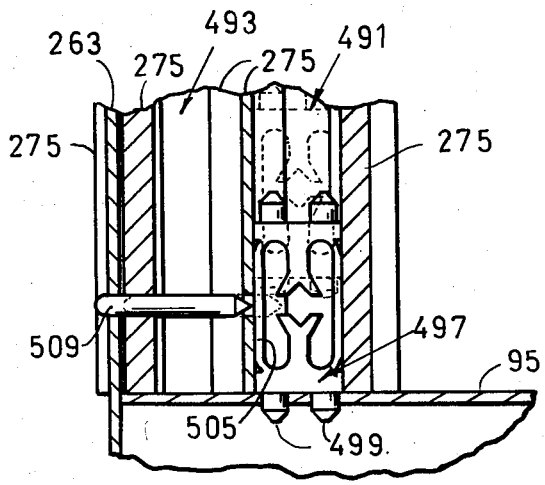
FIG. 18 is an enlarged, partially sectional, elevational view of the lower end of a portion of the inside casing assembly of FIG. 10 taken along the line 18—18 of FIG. 10 and additionally showing a closure slide retainer block (in its compressed state) in its engaged position and in a phantom view in its unengaged position.
Figure 28:
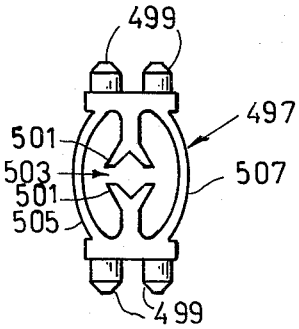
FIG. 28 is a front elevational view of a closure slide retainer block in its uncompressed state adapted for use with the pocket window of FIG. 1.
Figure 29:
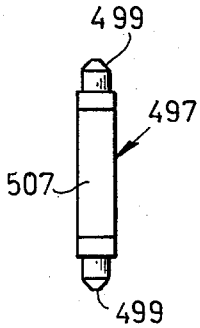
FIG. 29 is a right side elevational view of the closure slide retainer block of FIG. 28.

Referring now specifically to FIG. 18 the opposite ends of inside casing 275 of each window are preferably fastened to the sill assembly 15 and to the window head insert retaining member 159 by utilizing a flexible, closure slide retainer block 497 having two longitudinally extending pins 499 at each end, the main body of which can be compressed longitudinally by an installer so that it can be slid into each end of the inside casing 275 and more specifically into first recess 491 formed in the E-shaped inside casing 275. Referring now also to FIGS. 28 and 29, this closure slide retainer block 497 is hollow and generally barrel shaped in its normal, uncompressed state, with a front and back opening, and has two pairs of outwardly, longitudinally, extending pins 499 at each end, and a pair of Y-shaped tabs 501 projecting toward each other from each of said ends and which define an opening 503 at the V-ends of the tabs 501. In side view the closure slide retainer block 497 is generally I-shaped, and further includes two flexible curved (in its uncompresses state) sidewalls 505 and 507. An installer can then slidably engage (or disengage) the closure slide retainer block 497 by utilizing a tool having a rod like end and inserting the rod end into the opening 503 of the retainer block 497 and sliding its lower end downwardly so that pins 499 fit into registering apertures located in flange 95 of sill member 15 (as best seen in FIGS. 18 and 8). Similarly the upper end of the inside casing 275 extending within channel 179 is attached to the horizontally extending arm of L-shaped flange 175 of window head track 121 (FIG. 6). A liner pin 509, inserted into and extending through apertures in two of the walls near the lower end of the inside casing 263, which walls define second recess 493, and through a slotted aperture in the lower end of flange 267 of inside closure strip 263 (as best seen in FIG. 9), extends at its pointed end into the first recess 491 and against a middle portion of one of the now straightened flexible sidewalls 505 of closure slide retainer block 497 so that its wall 505 can be pushed inward by said liner pin 509 thereby tightening the closure slide retainer block 497 in said recess. The inside casing assembly 275 can also be conventionally attached in the same manner as the outside casing assembly 273.

Figure 25:
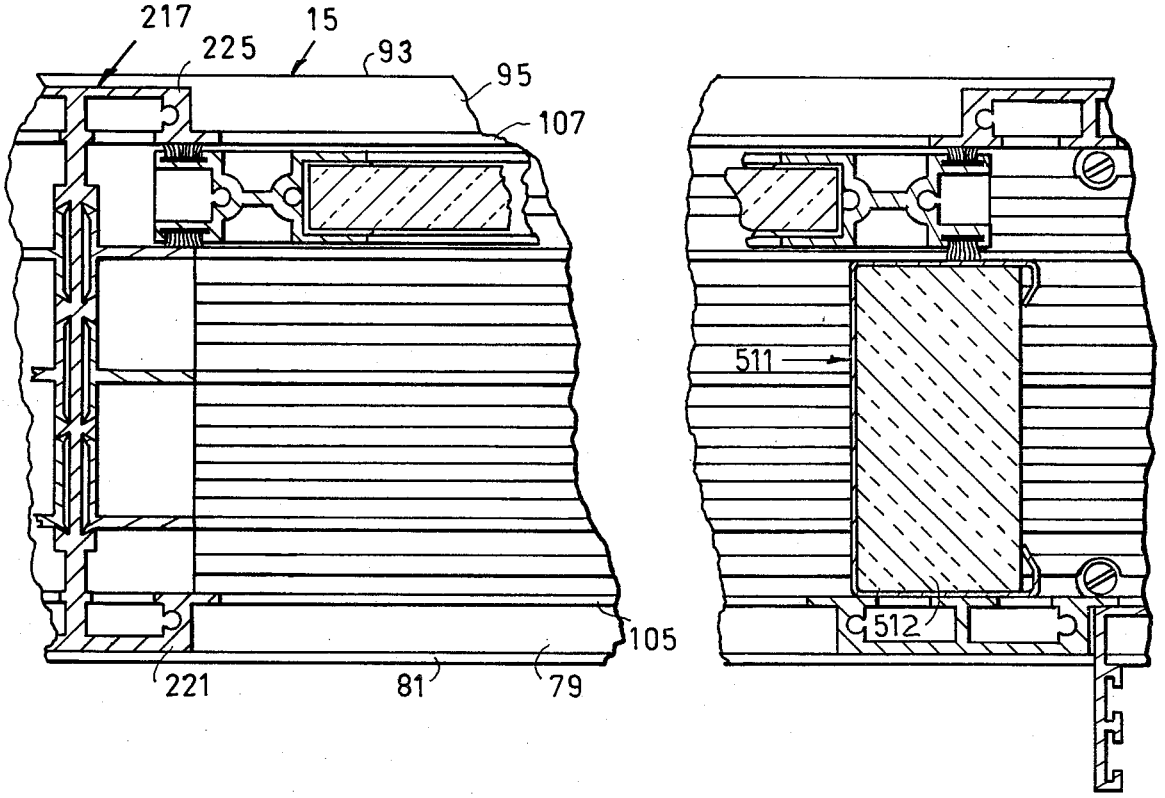
FIG. 25 is a partially broken, top plan view of the right window's sill assembly and additionally showing a filler unit installed in the empty space created when only one sash is utilized in the embodiment of the present invention.
Figure 26:
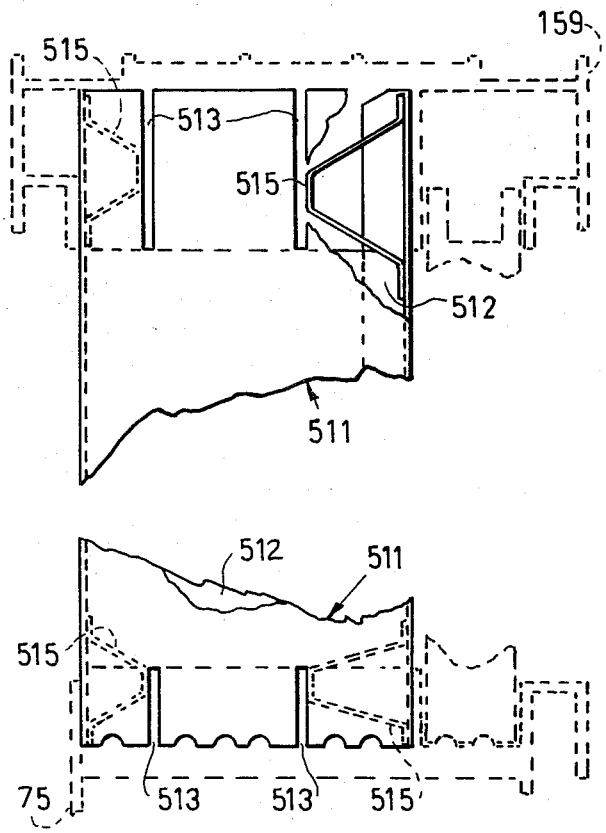
FIG. 26 is a simplified, partially broken, partially broken away, front elevational view of the filler unit of FIG. 25 and additionally showing, in phantom view, portions of the window header assembly, window sill assembly and one sash.
Figure 27:
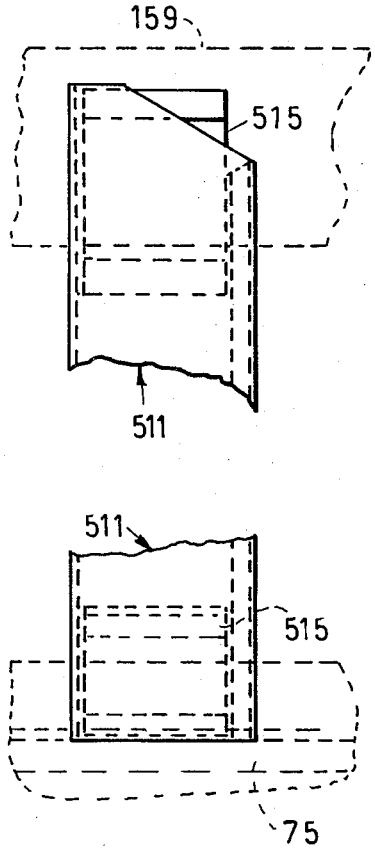
FIG. 27 is a partially broken, right side elevational view of the filler unit of FIG. 26.

Referring now to FIGS. 25 through 27, a filler unit, 511 which is generally U-shaped, in cross section, and normally vertically oriented, can be utilized at one side of each window in the empty space or opening created when less than the full number of sash 3 are used, for example in the preferred embodiment, when less than four inner sash 3 are used. The filler unit 511 utilized in this example, in the preferred embodiment shown in FIGS. 26 and 27, has a width such that it can be used when one sash 3 is used in the window, three adjacent sash having been removed; different widths being required when the opening is different. The filler unit 511 fits in an opening near the pocket end of the window so as to seal it against adverse weather conditions and in particular against thermal losses in its unsealed opened condition. The filler unit 511, utilizes a conventional fiberglass insert 512 therein and which longitudinally extends from one end of the filler unit 511 to its other end so as to increase the thermal efficiency of the window unit. The ends of the filler unit 511 have slots 513 formed therein, as when it is placed intc its vertical position in the opening, the ends fit over the particular inserts used in the window sill retaining members 17 and 19 and a window header inserts 159 (portions of which are shown in phantom) and are held in place against these inserts by two oppositely disposed spring clip retainers 515 at each end and which laterally extend from the sidewalls of the filler 511.

In order to provide proper drainage for the double window frame unit 7, it should include conventional drainage means such as slots (not shown) or other similar opening, in both the window sill track inserts 133, 135 and 137 and the retaining members 17 and 19, at about one foot intervals, as well as appropriate notches (not shown) or other similar opening at the sill ends of outside portions of the vertical window framings, the center post retainer 217 and outside casings 273, thereby providing a drainage flow path allowing water to flow through the slots in said window sill track inserts and then through the slots below it in the window sill tracks to the sill 15 and out through appropriate drain holes or other similar openings in the outside lower flange 113 of said window sill tracks to exit through said notches in said vertical framings.

Installation of the pocket window is quickly and readily assembled by first installing a subframe assembly, including bucks 97 horizontally extending at the top and bottom of the pocket and window openings and vertically extending bucks at the end of the pocket openings. The pocket frame units 9 and 11 are then installed by first assembling its components; attaching the inner end of the lower horizontal retaining member 277 to the lower end of the pocket jamb 31 and then attaching the upper end of the pocket jamb 31 to the inner end of the pocket header 285 and then attaching the lower and upper ends of the interior and exterior closures 263 and 261, respectively, to the outer ends of the retainers 277 and 285, respectively. Then all the desired number of sill sash guideway slide in inserts are installed in the pocket header retaining member 285 and lower track 277. After the pocket frame units 9 and 11 are properly assembled they are conventionally affixed within their respective pocket openings. The dam 299 is then conventionally fixed in place at the end of each pocket frame unit 9 and 11. The window frame unit is then installed by first assembling most of its components; the lower end of the center post retaining member 217 is attached to the middle of the lower window sill 15 and to one end of both retaining member then the jamb and header slide in inserts are installed in the center post 217, header retaining member 159 and both track sills 75. Then the upper end of the center post retaining member 217 is attached to the middle of the header track 159, and then the top and bottom ends of the exterior casing 273 are attached to the header insert retaining member 159 and both retaining members 17 and 19 at their pocket ends, respectively. This assemblied window frame is then inserted into the window opening from the inside of the building. The track liners, 301 and 303, previously slipped into their coacting grooves in the retaining members 17 and 19 are moved so that they bridge the tracks of the sill and pocket and are then screwed in place. If however, the tracks and inserts of the preferred embodiment are utilized, all such snap in type of inserts may then be installed. Thereafter all the desired number of sash 3 are installed within their respective guideways formed by said inserts and finally the upper and lower ends of the interior casing member 275 are affixed to the pocket ends of the window header and sill insert retainers 159 and 75, respectively, by utilizing the flexible closure slide retainer blocks 497 and associated liner pins 509. All the attachments are conventionally made by the use of one or more screws except as otherwise specified.

While only certain preferred embodiments of this invention have been shown and described by way of illustration, many modifications will occur to those skilled in the art and it is, therefore, desired that it be understood that it is intended herein to cover all such modifications as fall within the true spirit and scope of this invention.

What is claimed as new and what it is desired to secure by Letters Patent of the United States is:

1. A sill assembly for a multisash pocket window having a sash that is horizontally movable and supported on rollers, said assembly comprising an elongated horizontally arranged insert retaining member having a plurality of parallel elongated and laterally spaced apart upstanding ribs which have a coplanar arrangement and cooperate in defining a plurality of elongated shallow recesses in the space therebetween, a plurality of elongated insert members which are arranged in the respective recesses and therein retained by the spaced apart ribs that cooperate in defining the respective recesses, and a pair of elongated horizontally arranged parallel rails which are spaced apart and arranged to therebetween and thereon support a supporting roller for said sash, at least one of said rails constituting an integral part of one of said insert members.

2. A sill assembly in accord with claim 1 wherein the other of said rails also constitutes an integral part of said one insert member.

3. A sill assembly in accord with claim 1 wherein the other of said rails constitutes an integral part of another of said insert members.

4. A sill assembly in accord with claim 1 wherein said one insert member comprises an elongated generally horizontally arranged base section that is located in one of said recesses, and has opposite side portions, wherein said one recess is defined by a pair of spaced apart ribs that have respective side walls which are inclined and engage the respective side portions of said base section to retain the base section in said one recess.

5. A sill assembly in accord with claim 1 wherein the other of said rails constitutes an integral part of said retaining member.

6. A sill assembly in accord with claim 5 wherein said other rail is an integral part of one of said ribs, and wherein said one rib is arranged to cooperate in defining the recess in which said one insert member is arranged.

7. A sill assembly in accord with claim 1 wherein said one insert member comprises an elongated generally horizontally arranged base section that is located in one of said recesses, and wherein said assembly comprises a pair of elongated, horizontally arranged parallel upright sections which are spaced apart and arranged to straddle the lower end of said sash, at least one of said upright sections constituting an integral part of said one insert member.

8. A sill assembly in accord with claim 7 wherein the other of said upright sections constitutes an integral part of said retaining member.

9. A sill assembly in accord with claim 7 wherein the other of said upright sections constitutes an integral part of another of said insert members.

10. A sill assembly in accord with claim 7 wherein said base section has opposite side portions which are contiguous with the respective ribs that define said one recess, and wherein said one upright section is integrally joined to the base section at one of said side portions.

11. A sill assembly in accord with claim 7 wherein said base section has opposite side portions which are contiguous with the respective ribs that define said one recess, and wherein said one upright section is integrally joined to the base section between said side portions.

12. A sill assembly in accord with claim 1 wherein said insert retaining member has opposite ends, and wherein said insert members were inserted in said recesses at one of said opposite ends.

13. A sill assembly in accord with claim 12 wherein said insert members are adapted for insertion in the recesses between said opposite ends.

* * * * *